United States Patent [19]

Pfeiffer et al.

[11] 4,062,127

[45] Dec. 13, 1977

[54] METHOD FOR THE CONTINUOUS DRYING OF WET, GRANULAR AND/OR LUMPY MATERIALS AND DEVICE FOR CARRYING OUT THE METHOD

[75] Inventors: Roland Pfeiffer, Bensberg-Frankenforst; Wilhelm Bongert, Bochum; Heinz-Dieter Waldhecker, Bensberg-Refrath, all of Germany

[73] Assignee: Klöckner-Humboldt-Deutz Aktiengesellschaft, Germany

[21] Appl. No.: 591,843

[22] Filed: June 30, 1975

[30] Foreign Application Priority Data

July 1, 1974 Germany ..... 2431522

[51] Int. Cl.[2] ..... F26B 3/34

[52] U.S. Cl. ..... 34/1; 333/95 A

[58] Field of Search ..... 34/1, 25, 216, 217, 34/164; 219/10.55 A, 10.55 M; 426/242, 241, 243, 465; 333/95 A

[56] References Cited

U.S. PATENT DOCUMENTS

| | | | |
|---|---|---|---|
| 1,668,446 | 5/1928 | Anderson | 34/25 |
| 2,237,635 | 4/1941 | Saxe | 34/25 |
| 2,511,896 | 6/1950 | Bingley | 333/95 A |
| 3,008,104 | 11/1961 | Scapple et al. | 333/95 A |
| 3,063,848 | 11/1962 | Van Gelder | 426/242 |
| 3,096,161 | 7/1963 | Morrison et al. | 34/1 |
| 3,263,052 | 7/1966 | Jeppson et al. | 219/10.55 A |
| 3,434,220 | 3/1969 | Forster | 34/1 |
| 3,474,544 | 10/1969 | Holden, Jr. et al. | 34/1 |
| 3,528,179 | 9/1970 | Smith | 34/1 |
| 3,737,608 | 6/1973 | Nagao et al. | 219/10.55 R |
| 3,775,860 | 12/1973 | Barnes et al. | 34/1 |
| 3,900,958 | 8/1975 | Bongert et al. | 34/216 |
| 3,906,115 | 9/1975 | Jeppson | 426/243 |

FOREIGN PATENT DOCUMENTS

| | | | |
|---|---|---|---|
| 382,721 | 12/1964 | Sweden | 34/25 |
| 684,738 | 12/1952 | United Kingdom | 34/1 |

*Primary Examiner*—John J. Camby
*Assistant Examiner*—Larry I. Schwartz
*Attorney, Agent, or Firm*—Hill, Gross, Simpson, Van Santen, Steadman, Chiara & Simpson

[57] ABSTRACT

A method and apparatus for drying wet granular and/or lumpy materials, employs a chamber having a material inlet, a material discharge outlet, an inlet for a heated drying fluid and a vapor outlet. A perforate sieve-type material support extends along a path between the material inlet and the material discharge outlet to provide communication between the drying fluid and vapor outlet through the material and a microwave generating and transmitting device is located above the material path to irradiate the material with microwave energy as a part of the drying energy supplied to the material.

5 Claims, 1 Drawing Figure

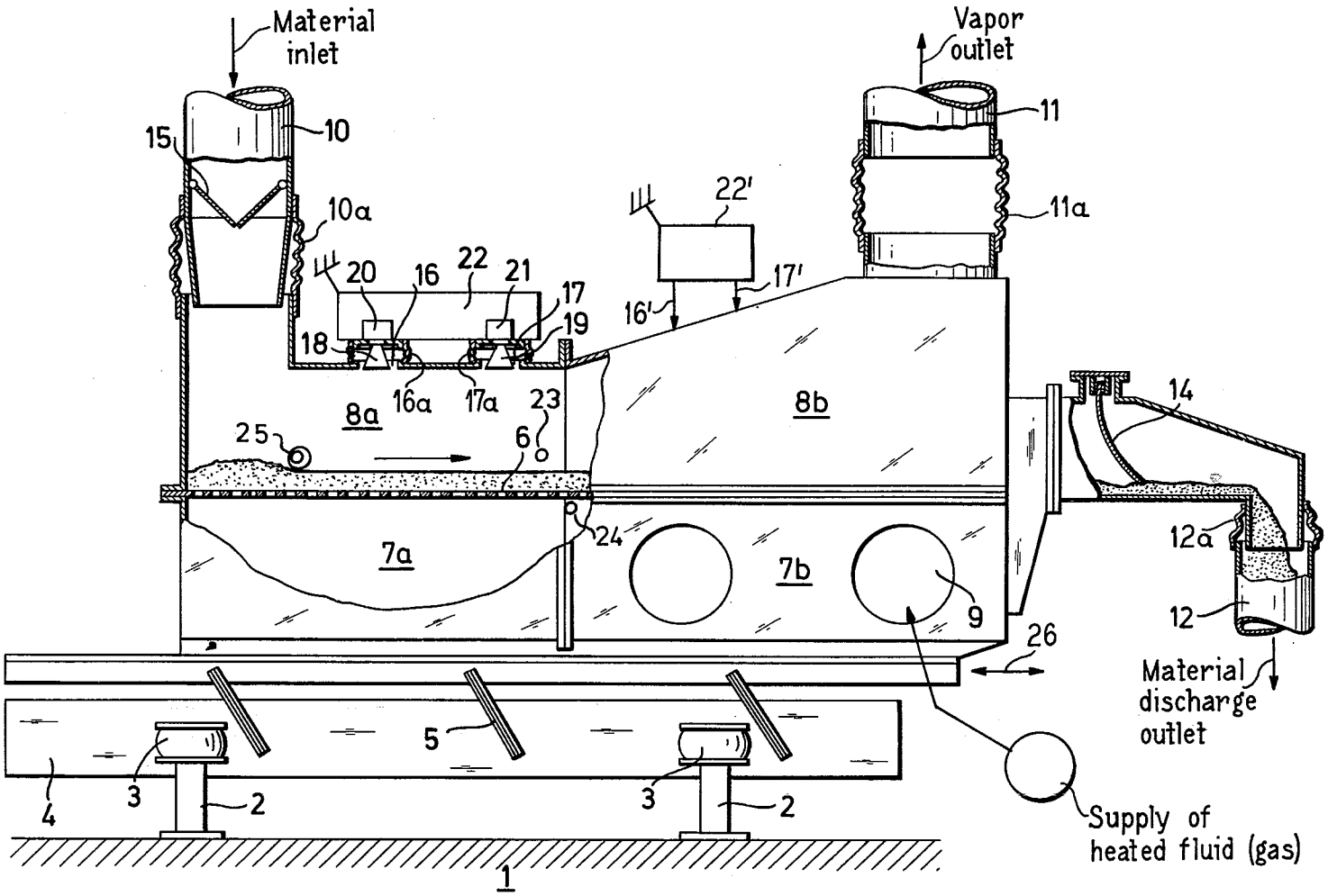
Vapor outlet
Material inlet
Material discharge outlet
Supply of heated fluid (gas)
11
11a
10
10a
15
14
12
12a
9
26
8b
7b
8a
7a
22'
17'
16'
17
19
21
22
16
16a
17a
20
18
23
6
24
25
2
3
5
4
1

METHOD FOR THE CONTINUOUS DRYING OF WET, GRANULAR AND/OR LUMPY MATERIALS AND DEVICE FOR CARRYING OUT THE METHOD

BACKGROUND OF THE INVENTION

1. Field of the Invention

This invention relates to a method and to an apparatus for the drying of wet-granular and/or lumpy materials, preferably materials which are undergoing a rotational or oscillatory movement.

2. Description of the Prior Art

It is known in the art to dry wet, granular and/or lumpy materials by means of passing hot gases or vapors therethrough. In this connection there is provided either a counterflow of material and gas, or the better controllable transverse flow of material and gas is utilized, in which the drying gas is introduced from above or below the material which is moving slowly forward on a frequently vibrating sieve floor. In this connection it is possible to regulate the drying of the material in individual zones and therefore attain a protective treatment of the material. By means of the vibrating movement of the sieve floor, a rotational or oscillatory movement takes place which, if need be, is reinforced by fluidization. The aforementioned drying methods do, indeed, lead to a sufficient drying of the material; however, they are adapted only conditionally to a stepped drying accuracy with respect to temperature and time as required by many products.

SUMMARY OF THE INVENTION

It is therefore the primary object of the invention to provide a drying method, and apparatus for carrying out the method, to improve the present drying techniques and avoid the disadvantages thereof.

This object is attained, according to the invention, in that the drying energy is applied to the material either entirely, or partially, through the introduction of microwaves. Advantageously, it is possible to introduce the drying energy into the interior of the quantity of material, and there into the middle of the material particles, and at the same time to increase the introduction of energy so that a very short period of drying can take place without having to fear an overheating of the material on the inlet side of the drying energy. Beyond this, it is possible to attain a controllability of the drying energy not attainable by means of the introduction of drying gases or vapors, as no regulating steps connected with delay in time are to be carried out. In particular, there is no dependence of the drying on the heat capacity of the drying gas, the pipe conduits and the vibrating system; but a direct immediate adaptation is possible within the framework of the technical possibilities of the introduction of energy into the material at the material temperature. With a vibration and/or fluidization of the material, providing material movement, the vapors resulting upon the drying in the interior of the quantity of material, may easily reach the surface of the material, while at the same time ever new particles of material enter into the heating zone in the middle of the material, so that a rapid deeply-penetrating drying of all particles results, as is not attainable with other methods.

In one embodiment of the invention, it is provided that the drying energy is conveyed to the material partially by means of microwaves and partially by means of gases or vapors. In this way it is advantageously attained that only a part of the drying energy must be supplied by microwaves, and that, within the framework in which the supply of gases or vapors brings with it no decrease in the quality of the material, energy may be produced at a more favorable cost.

In another embodiment of the invention, it is provided that the materials are highly heated for a short time. In this manner there results a particularly protective conservation, as a short temperature increase acts more strongly on the destruction of microorganisms than on an alteration of the quality of the material. Drying by means of microwaves ensures, to advantage, that a very short and sharp increase of temperature is to be attained within the interior of the material to be dried. In this manner, no stored heat remains standing in the conduits, walls, etc of the system, so that a more rapid recooling of the material is possible.

It is provided in another embodiment of the invention that the heating is high for a short period of time and subsequently low for a longer period of time. In this way, particularly in the case of foodstuffs which are inclined to darkening reactions, it is attained that no worsening or deterioration in the quality must be taken into consideration, even if as a whole a high drying energy must be introduced into the material. By means of a subsequent drying with low temperature as a final drying of the material, without deterioration of the quality, the desired final moisture content may be attained. By means of the combination of microwave drying as a high-heat, short-drying step and drying by means of gases or vapors as a low-heat, long-drying step, both a complete destruction of microorganisms, as well as a thorough final drying may accordingly be attained without, as a whole, an excessively long or excessively high drying taking place.

Furthermore, in one embodiment of the invention, it is provided that for the control of the drying, the absorption of the microwave beams is measured upon passage of the beams through the material. Through the utilization of the step that the absorption of the microwave beams upon passage through the material is a frunction of the moisture of the material passed through, advantageously therefore a simple measuring of the drying effect is possible. Without a complicated measuring of the residual moisture being necessary outside of the drying chamber, the moisture of the material may thus be continuously measured during use of a partial drying stream, and the drying operation may be controlled according to the measuring values.

In a further embodiment of the invention, it is provided that in the measuring zone a uniform thickness of the layer of material is adjusted. In this way, it is advantageously attained that the measured absorption supplies a direct measure of the moisture, and the consideration of the thickness of the layer of material, which is otherwise necessary, is eliminated.

In a device for carrying out the method, it is provided that the device include microwave transmitters which are constructed to include magnetrons or klystrons. In this way, advantageously, the microwave transmitters, already known and constructed in series, are inserted in the apparatus, and permit a construction favorable with respect to the cost of the entire system.

In a further embodiment of the invention, the microwave transmitters are arranged and mounted stationary over a covering hood of the drying chamber. In this manner it is advantageously attained that the transmitting devices are excluded from the alternating stress of the vibrating device and, thus, have an increased durability. The covering hood in this connection advantageously acts as a conducting member for the microwaves.

In a further embodiment of the invention, it is provided that the microwave transmitter has an energy transfer member having a hollow conducting meander structure. In this way it is attained that an optimum utilization of the radiation energy is ensured. From the interior of the hollow conductor, no rays can escape to the exterior as scattered radiation, and the entire energy introduced is utilized for drying. By means of the meander-shaped construction, it is attained that with only one transmitter device over a small surface, a multiple radiation passage through the drying material is attained. This results in a compact and efficient arrangement.

In a further embodiment of the invention, it is provided that temperature measuring members are disposed in the drying material to generate control pulses for the microwave transmitters. In this way it is advantageously possible to accurately and continuously supervise the drying temperatures, and with the aid of the transmitter energy to maintain accurate drying temperatures both in the short, high heat drying process as well as also in the long, heavy drying process and to obtain a corresponding high quality of the drying material.

Furthermore, in one embodiment of the invention, it is provided that above and below the material layer, measuring or test probes are arranged for measuring the absorption of microwaves. In this manner there results a simple build-up of an absorption measuring interval within the drying chamber.

In a further embodiment of the invention, it is provided that the device has measuring and regulating devices for the adjustment of a uniform thickness of material layer. By adjusting the material to a uniform thickness, there advantageously results an approximately linear dependence of the absorbed radiation on the residual moisture, so that the regulation of the residual moisture may take place in a particularly simple manner.

In still another embodiment of the invention, it is provided that under the drying material a sieve-type floor or perforate support is provided for passage of a flow of drying gases or vapors. In this way it is advantageously possible to supply heated gases or vapors to the drying material, the gases or vapors being capable of taking over both the subsequent drying as well as also the supply of energy in addition to the microwave drying energy. At the same time a fluidization (flow of material) may be attained which supports the drying operation.

BRIEF DESCRIPTION OF THE DRAWING

Other objects, features and advantages of the invention, its organization, construction and operation will be best understood from the following detailed description taken in conjunction with the accompanying drawing, on which there is a single FIGURE illustrating both the method and apparatus of the present invention.

DESCRIPTION OF THE PREFERRED EMBODIMENT

Referring to the drawing, the apparatus for drying with microwaves is illustrated as resting through a plurality of supports 2 and rubber-spring elements 3 on a foundation or bottom plate 1. The upper side of the rubber-spring elements 3 is connected with a counter mass 4 which is connected for oscillation through spring elements 5 arranged inclined with respect to a drying chamber 7, 8. The drying chamber comprises a perforate or sieve-type support 6, an upper compartment 8 and a lower compartment 7 as essential elements. The lower compartment 7 includes a drying gas or drying vapor inlet 9 which is connected to a supply of heated drying fluid (gas). The upper compartment 8 includes a material inlet 10, a vapor outlet 11 and a material discharge outlet 12. The material inlet 10 and the material discharge outlet 12 are equipped with movable closure members 14, 15, such as spring-loaded doors, in order to prevent passage of gases or vapors through these inlet and outlet conduits. The fixed and movable parts of the inlet or outlet openings are sealed by means of rubber-sleeves **10*a*, 11*a*, 12*a***, respectively.

The upper drying compartment 8 advantageously includes, at its forward end, a hood-type part having two passages 16 and 17 for receiving microwaves therethrough. Through likewise movable seals **16*a* and 17*a*, the passages 16 and 17 are connected with respective hollow conductor type transmitter outlets 18 and 19. A pair of transmitters 20 and 21 are located on a mounting 22 which is not connected with the other oscillatory elements but which is stationary. The seals advantageously consist of continuously elastic material. The oscillatory system with the counter mass 4 and the drying chamber 7, 8 is driven by means of a drive device schematically illustrated by the double headed arrow 26, preferably an electromagnetic oscillator. Preferably, on the discharge end of the drying zone which is radiated through by microwaves, absorption measuring probes 23 and 24 are located for the control of the residual moisture. A probe 25 for measuring the thickness of the covering layer is preferably disposed at the end of the material inlet zone. The probe 25** may include a rotatable eccentrically mounted member for adjusting the level of the material traveling there past.

The mode of operation of the apparatus according to the invention is as follows.

The material to be dried is fed through the material inlet 10 to the perforate support 6 through the closure members 15 at the forward portion **8*a* of the upper drying compartment 8. In the portion 8*a* the material is heated very highly for a short time, upon rotation of the material by a vibration through microwaves emitted from the microwave transmitters 20 and 21. In the lower front portion 7*a*** of the dryer, in this connection, either no quantity of heating air or drying gas is introduced, if heating is provided solely by means of the microwaves, or in the alternative only a small quantity of heating air or drying gas is supplied.

From the front portion the material—after being highly heated for a short time—reaches the rear portion **8*b* of the drying chamber in which it undergoes final drying. Final drying takes place, preferably, only through the medium of a drying air or gas, and may, however, also be supplemented by means of the insertion of a second set of microwave transmitters, schematically indicated by the components 22′, 16′ and 17′ which are similar to the components 22, 16 and 17** discussed above.

The supply quantity of drying air or gas, respectively, hereinafter simply referred to as a drying fluid, escapes through the vapor outlet, constituted by a pipe 11, while the dried and conserved material is discharged from the dryer through the material discharge outlet 12 in which is disposed the closure member 14. The migration of the material by means of the vibration drive may be so controlled in cooperation with the quantity of drying fluid passing through the sieve or perforate support 6 that the particles move in a dense flowing layer. Now the particles may undergo, through the microwave transmitter, a thorough heating for a short period of time from the inside to the outside of the particles, as is protectively attained with no heated method heretofore known.

During the drying operation, the position of the material surface is scanned by means of a probe 25 and is held constant by means of a control device connected to the probe 25 and not illustrated herein. Furthermore, by means of the probes 23 and 24, the absorption of the microwaves is measured upon passage through the material to regulate, by means of a control, the residual moisture of the material. The probe 23, of course, measures the incoming radiation, while the probe 24 measures the radiation available on the opposite side of the material so that the difference between the two measurements constitutes the amount of the absorbed radiation.

The construction provided in the drawing with microwave transmitters located over the upper portion of the drying chambers 7 and 8 may also be modified by means of an arrangement in which the microwaves radiate through the drying material through a meander-shaped hollow pipe conductor. Even so, it is not necessary that the measuring of the residual moisture in the dryer be undertaken. A separate transmitter device at the outlet of the dryer at which the drying material is branched off or deflected, preferably in a by-pass measuring interval, as a flow with a constant thickness, is likewise possible and offers advantages in the method of regulating the moisture level of the material.

The method and apparatus described above is not limited to the drying of water-containing material, but also permits utilization in the drying of materials containing organic or inorganic absorbing substances (hydrocarbon substances, $SO_2$ or other such substances).

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In a method for the continuous drying of moist-to-dripping wet, granular and/or lumpy materials, particularly foodstuffs, in which a vibrating feed chamber is provided with a material inlet and a material outlet and with a heating gas inlet device and a heating gas outlet device, the improvement therein comprising the steps of:

applying microwave energy as drying energy to the material in a first drying step, including the steps of generating microwave energy at a fixed point outside of said chamber, and flexibly coupling the microwave generator to the chamber to isolate the microwave generator from vibration and to prevent the escape of microwave energy; and applying hot gases to the material as the drying energy in a second drying step.

2. The improved method of claim 1, wherein:

the step of applying microwave energy is further defined as applying high intensity microwave energy for a short time; and the step of applying hot gases is further defined as applying hot gases for a longer period of time.

3. The improved method of claim 2, comprising the further step of:

measuring the absorption of the microwave radiation upon passage thereof through a uniform thickness of the material being dried.

4. Apparatus for the continuous drying of moist-to-dripping wet, granular and/or lumpy materials, particularly foodstuffs, comprising:

a closed vibrating drying chamber including a material inlet, a material outlet, a vibrating material support extending between said material inlet and said material outlet, a heating gas inlet, a heating gas outlet, and a microwave inlet;

a stationary microwave transmitter and movable seals flexibly coupling said microwave transmitter to said microwave inlet of said chamber in an area adjacent and downstream of the material inlet for radiating the material adjacent said inlet with microwave energy; and a sieve-type support within said chamber and downstream of said microwave inlet for supporting the material to be dried so that the hot gases flow through the material.

5. Apparatus according to claim 4, comprising:

means adjacent said material inlet for providing a uniform thickness of material traversing the drying apparatus; and measuring and regulating apparatus connected to said microwave transmitter and comprising test probes positioned above and below the uniform thickness for measuring the absorption of microwaves and generating the control pulses for controlling said microwave transmitter.

* * * * *